US007088326B2

(12) United States Patent
Lin et al.

(10) Patent No.: US 7,088,326 B2
(45) Date of Patent: Aug. 8, 2006

(54) SINGLE PIXEL DRIVER FOR TRANSFLECTIVE LCD

(75) Inventors: Hsiao-Yi Lin, Hsinchu (TW); Chi-Jian Wen, Hsinchu (TW)

(73) Assignee: Toppoly Optoelectronics Corp., Miaoli (TW)

( * ) Notice: Subject to any disclaimer, the term of this patent is extended or adjusted under 35 U.S.C. 154(b) by 444 days.

(21) Appl. No.: 10/419,889

(22) Filed: Apr. 22, 2003

(65) Prior Publication Data

US 2004/0212575 A1 Oct. 28, 2004

(51) Int. Cl.
*G09G 3/36* (2006.01)

(52) U.S. Cl. ..... 345/90; 345/92

(58) Field of Classification Search ..... 345/55, 345/89, 90, 91, 92, 97, 98, 204; 359/59, 60, 359/82

See application file for complete search history.

(56) References Cited

U.S. PATENT DOCUMENTS 6,414,665 B1 * 7/2002 Libsch et al. ..... 345/92
6,421,037 B1 * 7/2002 Chen ..... 345/92
2002/0047822 A1 * 4/2002 Senda et al. ..... 345/90
2003/0112213 A1 * 6/2003 Noguchi et al. ..... 345/96
2004/0212556 A1 * 10/2004 Senda et al. ..... 345/55

* cited by examiner

*Primary Examiner*—Bipin Shalwala
*Assistant Examiner*—Nitin Patel
(74) *Attorney, Agent, or Firm*—Harness, Dickey & Pierce, PLC

(57) ABSTRACT

A single pixel driving circuit for a transflective LCD is disclosed. It uses different digital/analog (D/A) signal converters to control the gamma correction signals of the transmissive liquid crystal capacitor and the reflective liquid crystal capacitor to improve the display quality of the transflective LCD. The driving circuit contains a first transistor and a second transistor whose gates couple together to a scan line, a first signal converter coupled to the source of the first transistor via a first data line, and a second signal converter coupled to the source of the second transistor via a second data line. The drain of the first transistor is coupled to the transmissive liquid crystal capacitor. The drain of the second transistor is coupled to the reflective liquid crystal capacitor.

9 Claims, 2 Drawing Sheets

SINGLE PIXEL DRIVER FOR TRANSFLECTIVE LCD

BACKGROUND OF THE INVENTION

1. Field of Invention

The invention relates to an LCD driving circuit and, in particular, to a driving circuit of a transflective LCD.

2. Related Art

Compactness and lightness are the main considerations for flat displays. The liquid crystal display (LCD) panel has become the mainstream of current displays on the market. The LCD panel can be categorized into active and passive ones. The reaction speed, resolution, quality and dynamical image display of active matrix LCD's are all better than the passive ones. Due to the requirement for high screen quality, the display panel has long been changed from monochromatic to true-colors. The power consumption, number of colors, and resolution of LCD's have received much attention. Therefore, it is the current trend to use active matrix panels with faster reaction speeds and more suitable for dynamical image applications.

Currently, a hot display technology is the so-called low temperature polysilicon thin film transistor liquid crystal display (LTPS TFT-LCD). It has the advantages of high brightness, low power consumption, ultra-high resolution, high screen quality, and fast reaction speed. Therefore, it is the most advanced and competitive technique in the TFT-LCD industry.

To lower the power consumption of the panel, most technologies take the reflective type or transflective type LCD panels. Currently, the transmissive mode and the reflective mode of the transflective type LCD panels use the same gamma curve to correct the brightness of each pixel. However, the transmissive liquid crystal and the reflective liquid crystal have different characters; therefore, their gamma curves should be different. Using the same gamma curve will affect the image quality. It is thus imperative to find a driving circuit that can improve the image quality of the transflective LCD's.

SUMMARY OF THE INVENTION

In view of the foregoing, an objective of the invention is to provide a driving method for transflective LCD's to improve its display quality.

To achieve the above objective, the disclosed transflective LCD includes a first transistor and a second transistor whose gates couple together to a scan line, a first signal converter coupled to the source of the first transistor via a first data line, and a second signal converter coupled to the source of the second transistor via a second data line.

In particular, the drain of the first transistor is coupled to the transmissive liquid crystal capacitor. The drain of the second transistor is coupled to the reflective liquid crystal capacitor.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
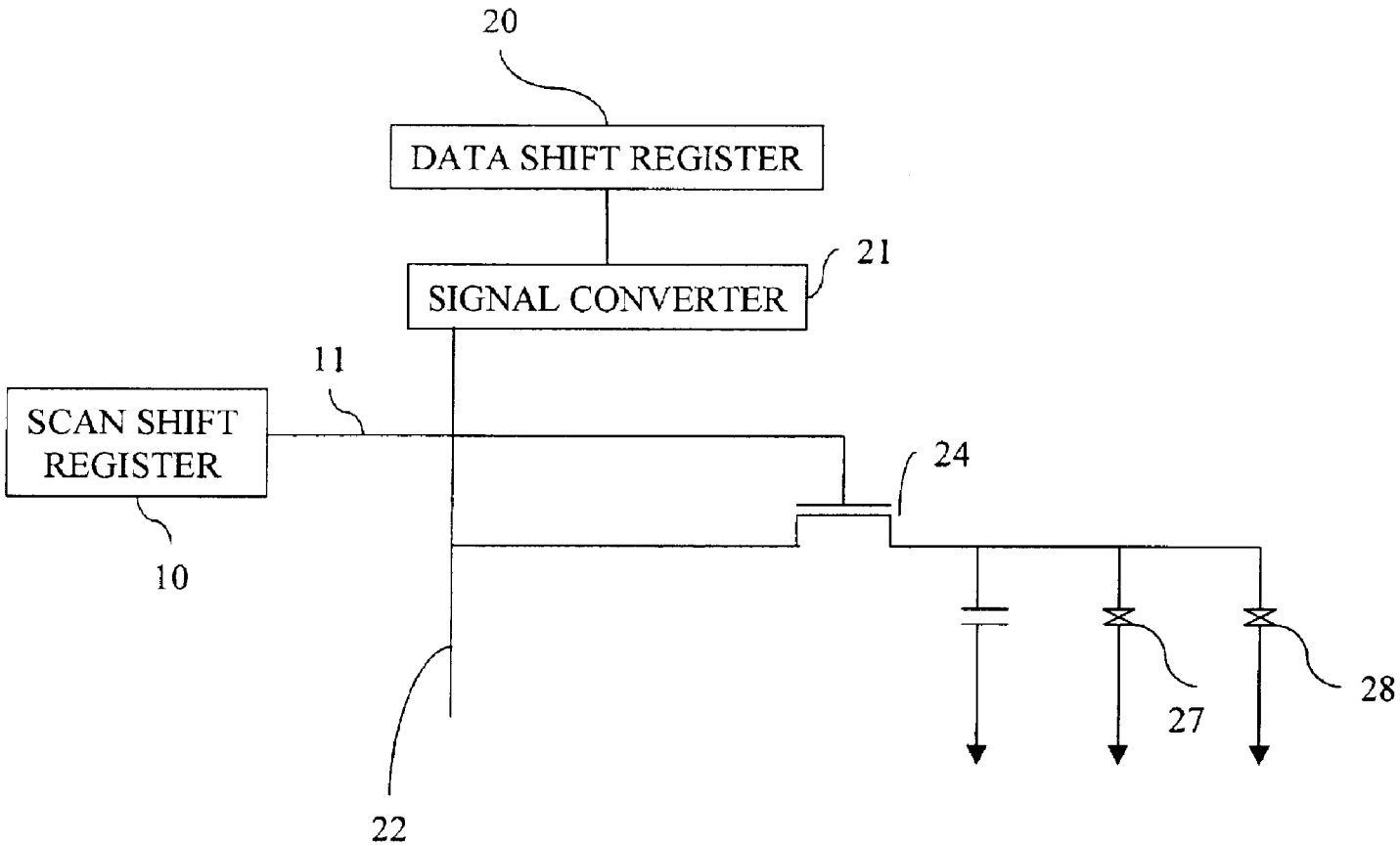
FIG. 1 is a single pixel driving circuit for transflective LCD's in the prior art.

The transflective LCD panel technology fully utilizes the environment light and reduces the use of backlight source. A tiny tilted reflective surface is made in each pixel as a reflective plate to separate the noisy light reflected by the surface from the image. The light source is more concentrated and the light is distributed to a fixed view angle, thereby reflecting toward the observer. This does not only effectively increase the light use rate, the brightness and contrast of the panel are also enhanced.

In the LCD, each pixel is driven in a crossing manner along the X and Y axes. The disclosed technology uses the active-matrix addressing to achieve high data density display effects with a better resolution. The adopted method is to employ the thin film technology to make transistors. The scanning method is used to arbitrarily select the ON and OFF of a pixel. Network-like tiny wires are drawn on glass as transmission lines. Electrodes are matrix switches formed from arrayed TFT's. A control switch is provided at each circuit cross point. Although the driving signal rapidly scans through each pixel, only selected pixels in the transistor matrix on the electrode obtain a sufficient voltage to drive the liquid crystal molecules. The liquid crystal molecules are thus rotated to be bright/dark. The unselected pixels are naturally dark/brightness in contrast.

The main objective of the disclosed transflective LCD panel is to reduce the power consumption of the LCD panel. This is achieved by using external light to reduce the use of backlight sources. Each pixel has a transparent area and a reflective area. The image signal of pixels is controlled by data lines.

For the transflective LCD panel in the prior art, the liquid crystals can be divided into a reflective area and a transparent area. The display in the reflective area is provided by reflective liquid crystals, while that in the transparent area by the transmissive liquid crystals. The image quality observed by the user is the result corrected by the gamma curve. The brightness corrections in both the reflective area and the transparent area use the same gamma curve.

The gamma mentioned in the specification refers to the correspondence functional curve between the input value and the output value. When the gamma value is 1, the curve is a 45-degree straight line, meaning that the input and output concentrations are the same. A gamma value smaller than 1 will make the output brighter, while a gamma value greater than 1 will dim the output. The greater the gamma is different from 1, the larger the curvature of the curve is. As a result of the gamma curve, the gamma corrections do not affect the concentration region of the image but only modify the concentration distribution. The user thus visually perceives the image being brighter (when the gamma value is smaller than 1) or darker (when the gamma value is greater than 1). The main action of the gamma corrections is in the middle tune. When the gamma value is greater than 1, the brighter part will be depressed while the darker part expanded. When the gamma value is smaller than 1, the brighter part is expanded while the darker part depressed.

As shown in FIG. 1, a scan shift register 10 is used to control a scan line 11, determining which pixel to turn on in the matrix. A data shift register 20 is used to control the signal converter 21. The data line 22 controls the switching of the transistor 24. The transistor 24 drives the transmissive liquid crystal capacitor 28 and the reflective liquid crystal capacitor 27, so that the liquid crystal molecules are rotated to allow the passage of light. The gamma curve correction signals of the transmissive liquid crystal capacitor 28 and the reflective liquid crystal capacitor 27 are provided by the signal converter 21.

When the scan line 11 scans and selects a particular pixel to emit light, the correction signal passes through a signal converter 21 to convert an analog signal into a digital signal. The correction signal is then passed to a transmissive electrode and a reflective electrode via the data line 22 and the transistor 24, correcting the brightness. That is, the transmissive liquid crystal capacitor 28 and the reflective liquid crystal capacitor 27 in the same pixel are corrected by the same gamma correction curve. Since the transmissive liquid crystal capacitor and the reflective liquid crystal capacitor have different characteristics, using the same gamma curve for corrections is not perfect.

Figure 2:
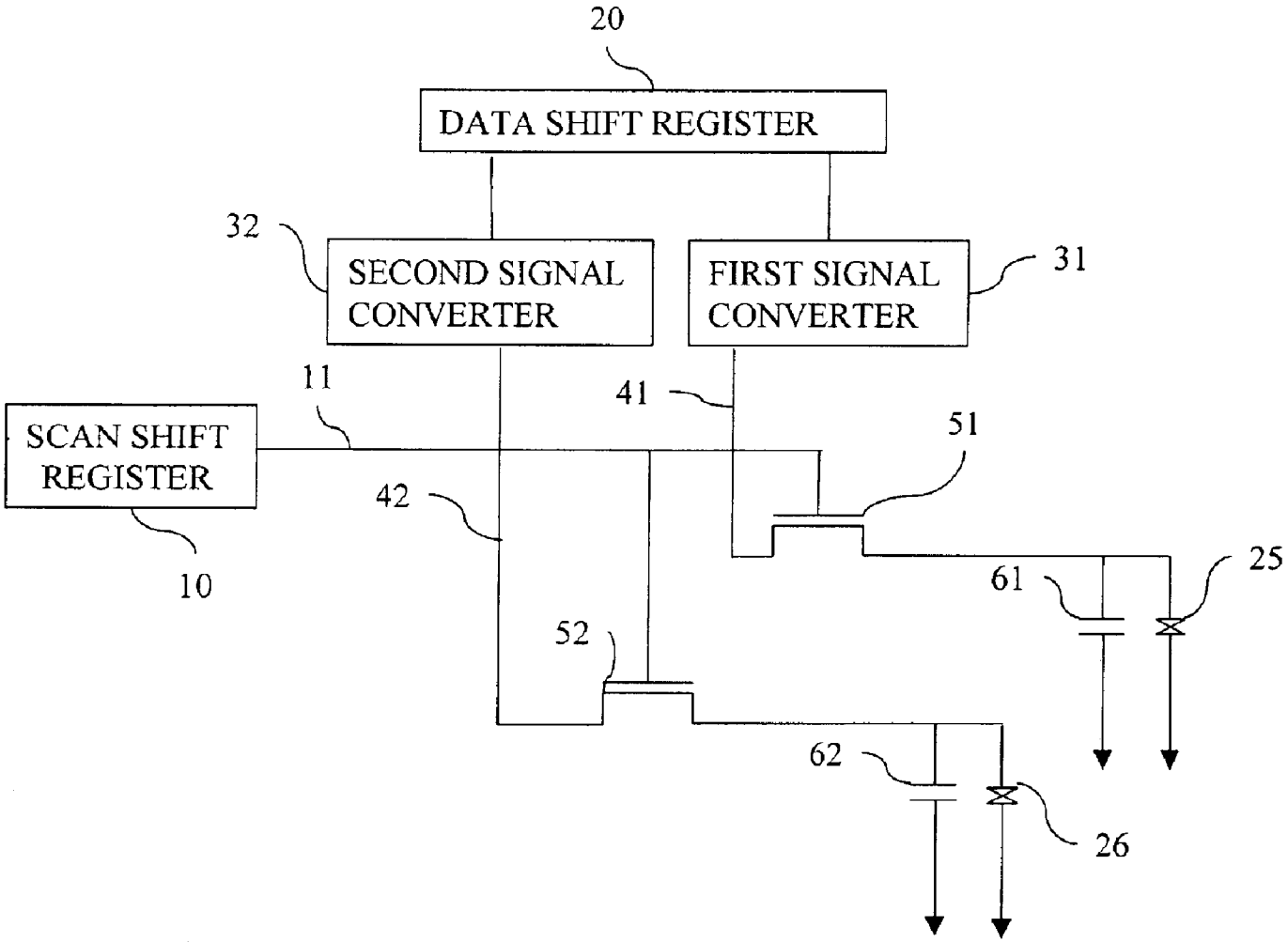
FIG. 2 is the disclosed single pixel driving circuit for transflective LCD's.

The invention proposes a method to solve the above-mentioned problems. As shown in FIG. 2, to increase the image quality of the transmissive liquid crystal capacitor and the reflective liquid crystal capacitor, the data lines for controlling the transistor switches are controlled by different signal converters. As shown in FIG. 2, the single pixel driving circuit contains a first signal converter 31, a second signal converter 32, a first transistor 51, and a second transistor 52. The pixel is comprised of a transmissive liquid crystal capacitor 25 and the reflective liquid crystal capacitor 26.

The gates of the first transistor 51 and the second transistor 52 are coupled together to the scan line 11. The source of the first transistor 51 is coupled to the first data line 41, and its drain is coupled to the transmissive liquid crystal capacitor 25. The source of the second transistor 52 is coupled to the second data line 42, and its drain is coupled to the reflective liquid crystal capacitor 26.

The first signal converter 31 controls the switching of the first transistor 51 via the first data line 41. The second signal converter 32 controls the switching of the second transistor 52 via the second data line 42. When the scan line 11 selects a pixel, the first transistor 51 and the second transistor 52 are turned on through the control of the first data line 41 and the second data line 42. The correction signal of the transmissive liquid crystal capacitor 25 goes through the first signal converter 31 and the first transistor 51 to correct the brightness. Likewise, the correction of the reflective liquid crystal capacitor 52 goes through the second signal converter 32 and the second transistor 52 to correct the brightness.

The first signal converter 31 and the second signal converter are D/A signal converters. The first transistor 51 and the second transistor 52 are thin film transistors (TFTs). The transmissive liquid crystal capacitor 25 is further connected in parallel with a storage capacitor 61 to maintain the voltage on the liquid crystal capacitor 25. Similarly, the reflective liquid crystal capacitor 26 is also connected in parallel with a storage capacitor to maintain the voltage on the liquid crystal capacitor 26.

Processing the gamma correction curves for the reflective and transmissive parts using different signal converters can produce better image quality. Moreover, it is not necessary to sacrifice charging time for enhancing the refreshing frequency.

Certain variations would be apparent to those skilled in the art, which variations are considered within the spirit and scope of the claimed invention.

What is claimed is:

1. A single pixel driving circuit for transflective liquid crystal displays (LCDs), the single pixel having a transmissive liquid crystal capacitor and a reflective liquid crystal capacitor, the single pixel driving circuit comprising:

a first transistor, which has a gate, a source and a drain;

a second transistor, which has a gate, a source and a drain;

a first signal converter, which is coupled to the source of the first transistor via a first data line; and a second signal converter, which is coupled to the source of the second transistor via a second data line;

wherein the drain of the first transistor is coupled to the transmissive liquid crystal capacitor and the drain of the second transistor is coupled to the reflective liquid crystal capacitor.

2. The single pixel driving circuit for transflective LCDs of claim 1, wherein the first data line controls the switching of the first transistor to drive the transmissive liquid crystal capacitor.

3. The single pixel driving circuit for transflective LCDs of claim 1, wherein the second data line controls the switching of the second transistor to drive the reflective liquid crystal capacitor.

4. The single pixel driving circuit for transflective LCDs of claim 1, wherein the first transistor is a thin film transistor (TFT).

5. The single pixel driving circuit for transflective LCDs of claim 1, wherein the second transistor is a thin film transistor (TFT).

6. The single pixel driving circuit for transflective LCDs of claim 1, wherein the first signal converter is a digital/analog (D/A) converter.

7. The single pixel driving circuit for transflective LCDs of claim 1, wherein the second signal converter is a digital/analog (D/A) signal converter.

8. The single pixel driving circuit for transflective LCDs of claim 1, wherein the transmissive liquid crystal capacitor is further connected in parallel with a storage capacitor.

9. The single pixel driving circuit for transflective LCDs of claim 1, wherein the reflective liquid crystal capacitor is further connected in parallel with a storage capacitor.

* * * * *